US007491027B1

(12) United States Patent
McFarland et al.

(10) Patent No.: US 7,491,027 B1
(45) Date of Patent: Feb. 17, 2009

(54) PIVOTING LOADER ATTACHMENT SYSTEM

(76) Inventors: David L. McFarland, 8191 130th Ave., SE., Gwinner, ND (US) 58040; Clayton A. Melrose, 405 S. 11th St., Oakes, ND (US) 58474

( * ) Notice: Subject to any disclaimer, the term of this patent is extended or adjusted under 35 U.S.C. 154(b) by 78 days.

(21) Appl. No.: 11/194,146

(22) Filed: Jul. 29, 2005

(51) Int. Cl.
*B66F 11/00* (2006.01)

(52) U.S. Cl. ..... 414/724; 37/468; 414/723

(58) Field of Classification Search ..... 414/723, 414/724; 37/468, 403; 403/112, 116, 113, 403/117; 15/78, 82, 340.1, 49.1, 93.1
See application file for complete search history.

(56) References Cited

U.S. PATENT DOCUMENTS 1,578,600 A 3/1926 Greatrix
4,790,084 A * 12/1988 Anderson et al. ..... 37/403
5,369,832 A * 12/1994 Hagger ..... 15/83
6,094,847 A 8/2000 Gallenberg ..... 37/422
6,269,620 B1 * 8/2001 Kasanic et al. ..... 56/16.6
6,540,030 B2 4/2003 Ohzeki et al. ..... 171/1
6,634,434 B2 10/2003 Ohzeki et al. ..... 171/63
6,640,906 B2 11/2003 Ohzeki et al. ..... 171/65
6,805,204 B2 10/2004 Bauer et al. ..... 171/111
7,089,692 B2 * 8/2006 Strait ..... 37/232

OTHER PUBLICATIONS

Dumping Hopper, www.bobcate.com, Website Printout, Publication Date Unknown.

* cited by examiner

*Primary Examiner*—Donald Underwood

(57) ABSTRACT

A pivoting loader attachment system for allowing an attachment to freely pivot with respect to a tractor's loader. The pivoting loader attachment system includes a pivoting connector pivotally attached to an attachment. The pivoting connector is attached to the front end connector of a front end loader. The pivoting connector pivots within a defined range of movement thereby limiting the range of movement the attachment makes with respect to a front end loader of a tractor.

12 Claims, 14 Drawing Sheets

PIVOTING LOADER ATTACHMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to tractor loaders and more specifically it relates to a pivoting loader attachment system for allowing an attachment to freely pivot with respect to a tractor's loader.

2. Description of the Related Art

Any discussion of the prior art throughout the specification should in no way be considered as an admission that such prior art is widely known or forms part of common general knowledge in the field.

Front end loaders for tractors have been in use for years. A conventional front end loader is comprised of a pair of support arms that are pivotally attached to a rear portion of the tractor (e.g. skid steer tractor) with a front mounting unit for removably securing attachments (e.g. buckets, blades, powered accessories, implements, etc.). Skid steer tractors typically utilize a "quick attach" that non-movably connects to a receiver structure non-movably attached to the attachment with the pivoting of the attachment occurring by the pivoting of the "quick attach" through the usage of hydraulic actuators. Traditional tractors have front end loaders that are pivotally attachable to attachments and utilize hydraulic actuators for controlling the pivoting of the attachment.

The main problem with conventional front end loaders is that they do not allow for the free pivoting of the attachment within a specific range thereby limiting their range of usage in applications that require at least some movement of the attachment with respect to the front end loader.

While these devices may be suitable for the particular purpose to which they address, they are not as suitable for allowing an attachment to freely pivot with respect to a tractor's loader. Conventional front end loaders do not provide for the free pivoting of an attachment with respect to a front end loader.

In these respects, the pivoting loader attachment system according to the present invention substantially departs from the conventional concepts and designs of the prior art, and in so doing provides an apparatus primarily developed for the purpose of allowing an attachment to freely pivot with respect to a tractor's loader.

BRIEF SUMMARY OF THE INVENTION

In view of the foregoing disadvantages inherent in the known types of front end loaders now present in the prior art, the present invention provides a new pivoting loader attachment system construction wherein the same can be utilized for allowing an attachment to freely pivot with respect to a tractor's loader.

The general purpose of the present invention, which will be described subsequently in greater detail, is to provide a new pivoting loader attachment system that has many of the advantages of the front end loaders mentioned heretofore and many novel features that result in a new pivoting loader attachment system which is not anticipated, rendered obvious, suggested, or even implied by any of the prior art front end loaders, either alone or in any combination thereof.

To attain this, the present invention generally comprises a pivoting connector pivotally attached to an attachment. The pivoting connector is attached to the front end connector of a front end loader. The pivoting connector pivots within a defined range of movement thereby limiting the range of movement the attachment makes with respect to a front end loader of a tractor.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a pivoting loader attachment system that will overcome the shortcomings of the prior art devices.

A second object is to provide a pivoting loader attachment system for allowing an attachment to freely pivot with respect to a tractor's loader.

Another object is to provide a pivoting loader attachment system that may be utilized upon various types of tractors (e.g. skid steer tractors).

An additional object is to provide a pivoting loader attachment system that may be utilized with respect to various types of attachments for a front end loader (e.g. bucket, blade, powered accessories, implements, land surface cleaning devices, etc.).

A further object is to provide a pivoting loader attachment system that allows for limited free pivoting of an attachment.

Another object is to provide a pivoting loader attachment system that allows for the attachment to be independently supported opposite of the front end loader upon an uneven ground surface.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
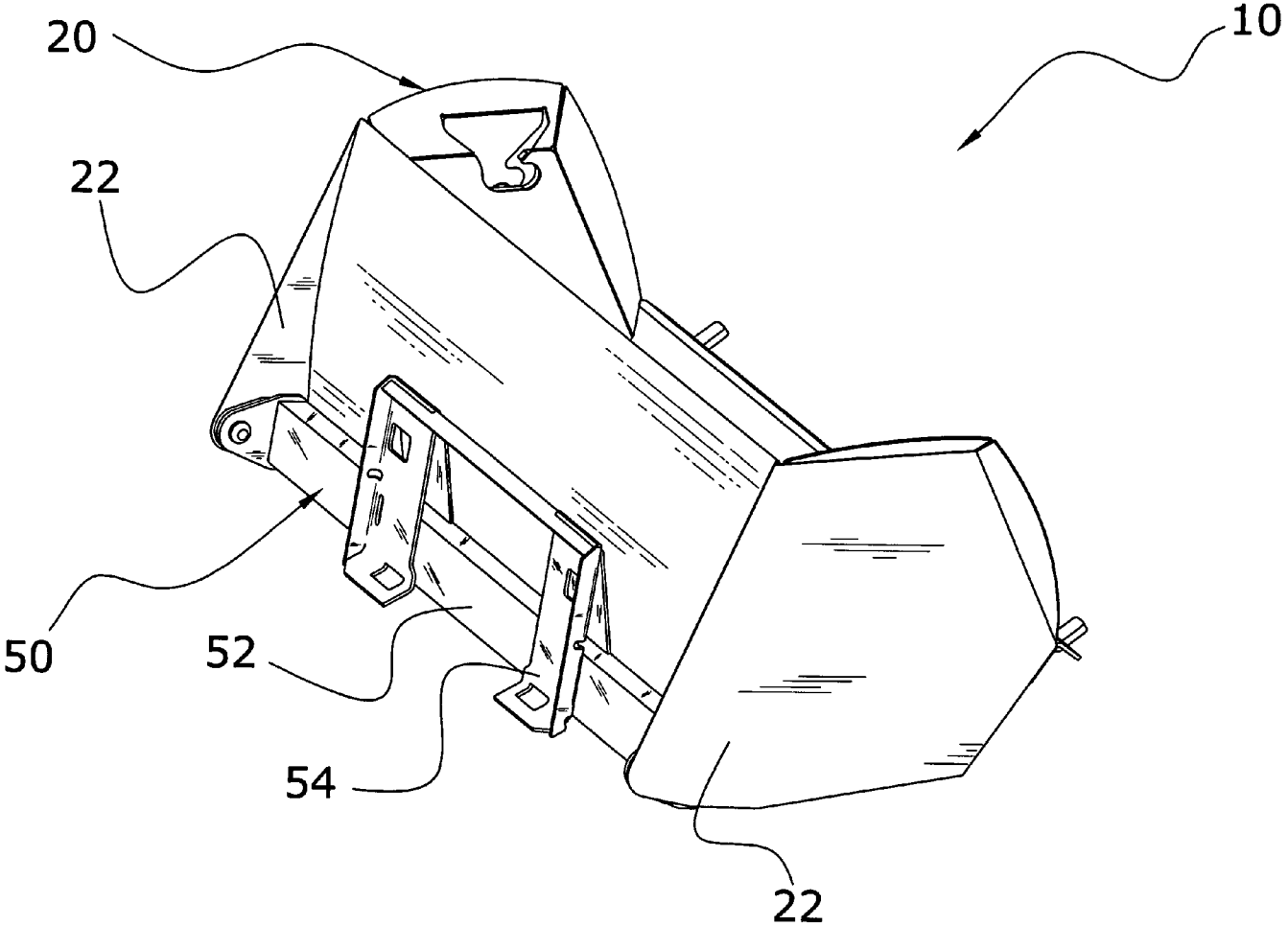
FIG. 1 is a rear upper perspective view of the present invention.

Turning now descriptively to the drawings, in which similar reference characters denote similar elements throughout the several views, FIGS. 1 through 9 illustrate a pivoting loader attachment system 10, which comprises a pivoting connector 50 pivotally attached to an attachment 20. The pivoting connector 50 is attached to the front end connector 16 of a front end loader 14. The pivoting connector 50 pivots within a defined range of movement thereby limiting the range of movement the attachment 20 makes with respect to a front end loader 14 of a tractor 12.

B. Attachment

Figure 6A:
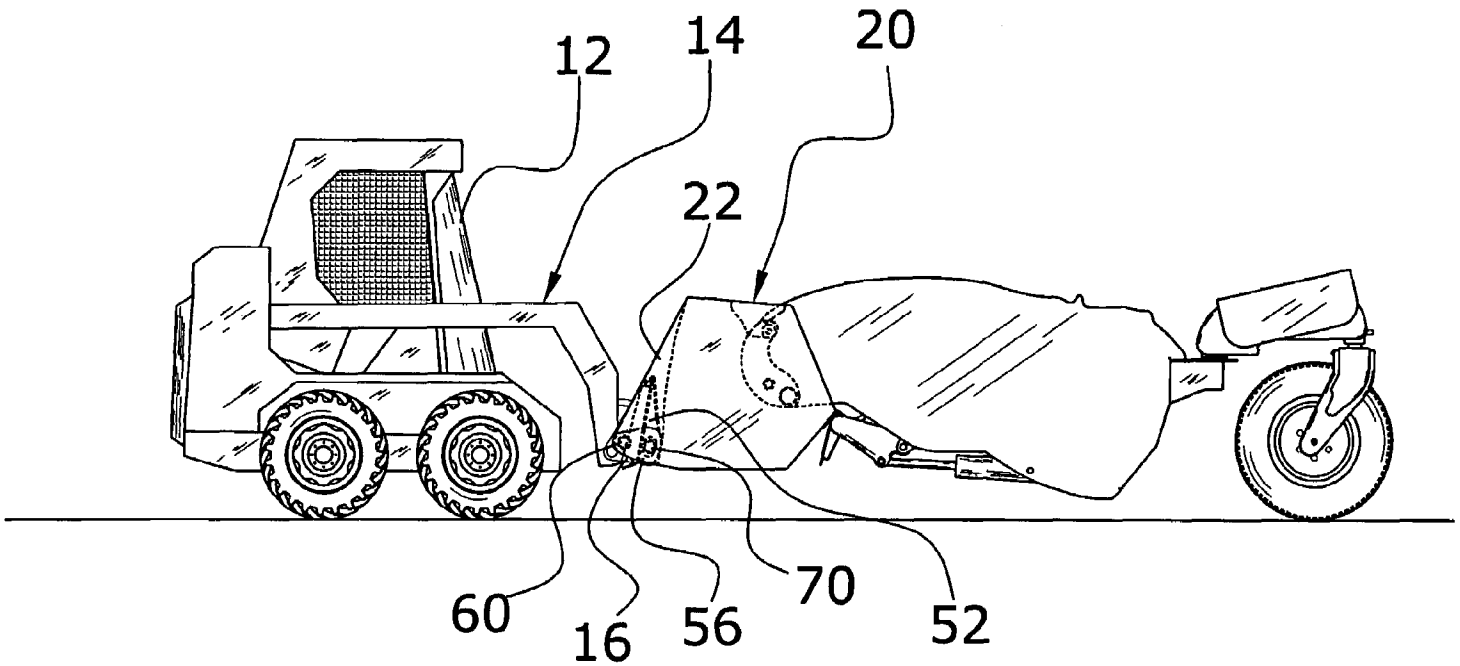
FIG. 6*a* is a side view of the present invention supporting an attachment on a flat surface.
Figure 6B:
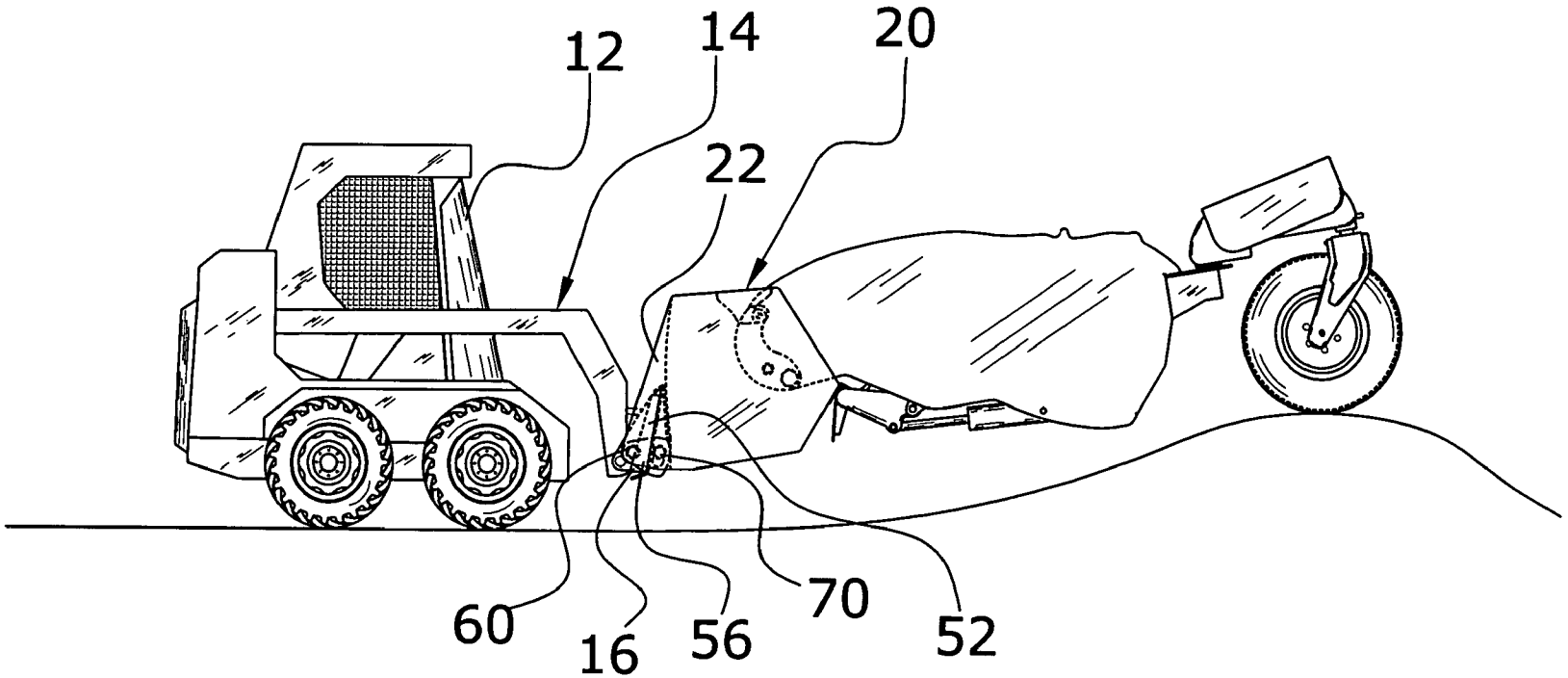
FIG. 6*b* is a side view of the present invention supporting an attachment where the front portion of the attachment is raised.
Figure 6C:
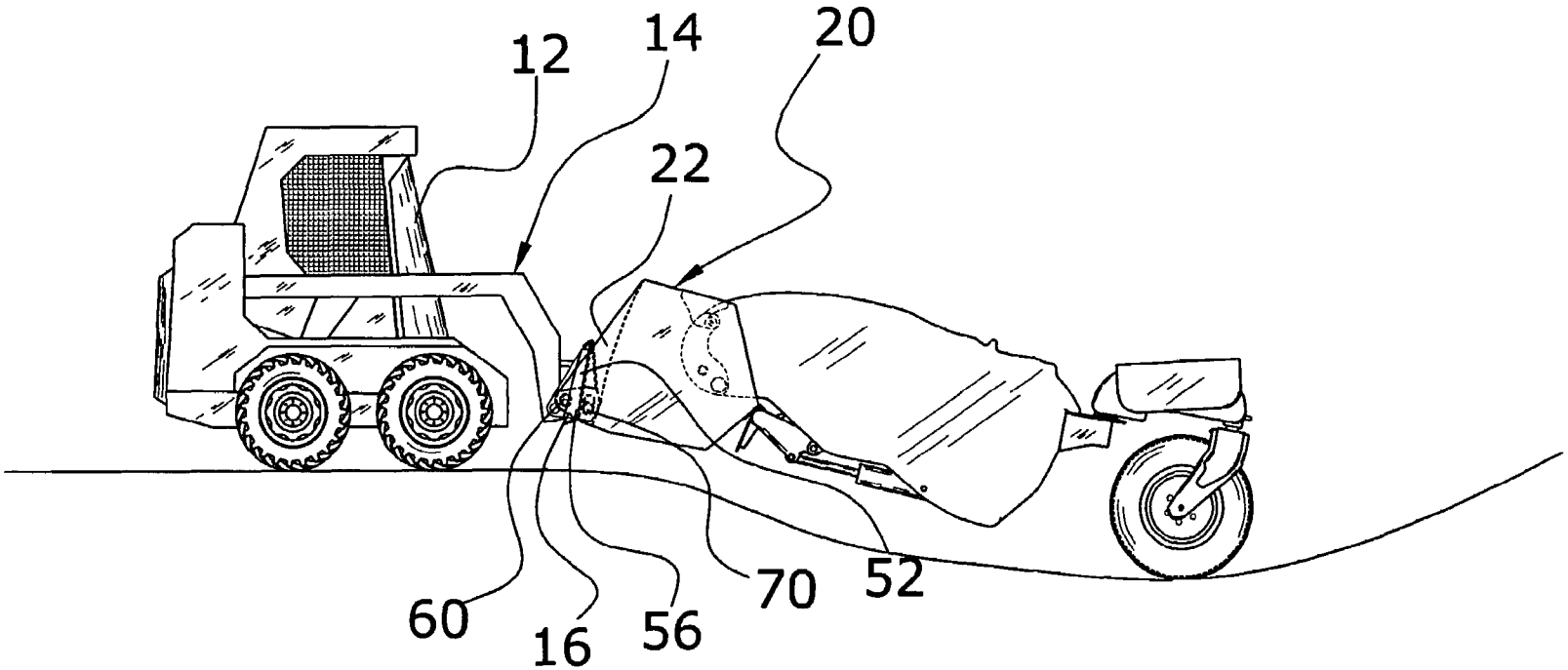
FIG. 6*c* is a side view of the present invention supporting an attachment where the front portion of the attachment is lowered.
Figure 7A:
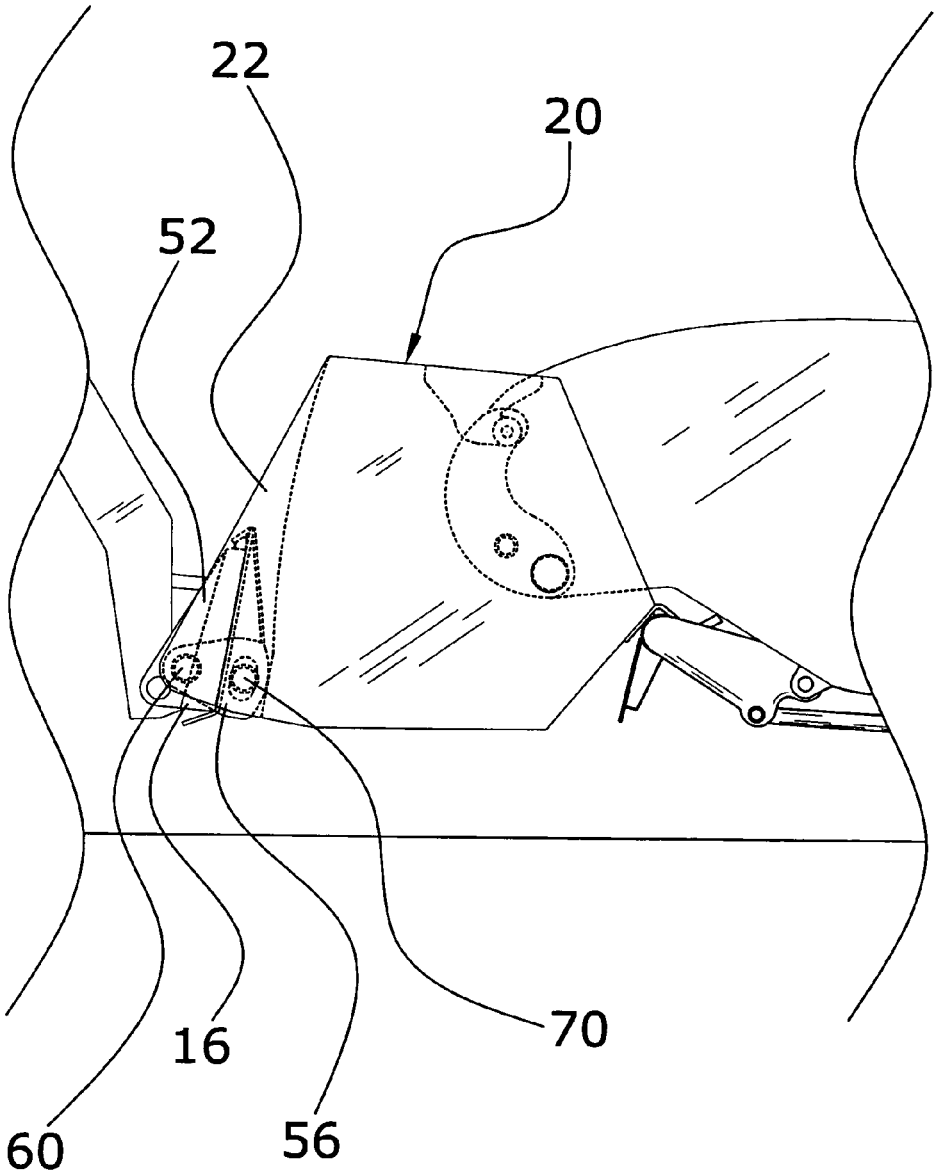
FIG. 7*a* is a magnified side view of the present invention from FIG. 6*a*.
Figure 7B:
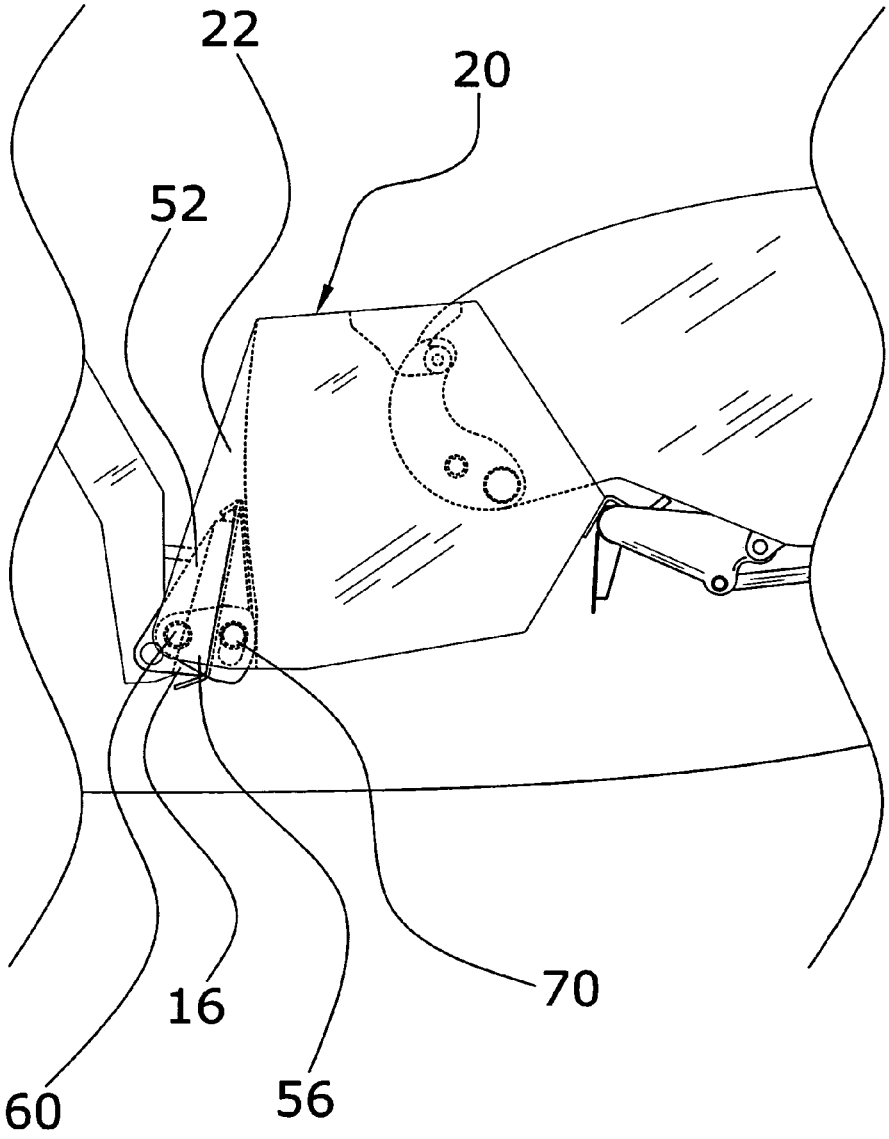
FIG. 7*b* is a magnified side view of the present invention from FIG. 6*b*.
Figure 7C:
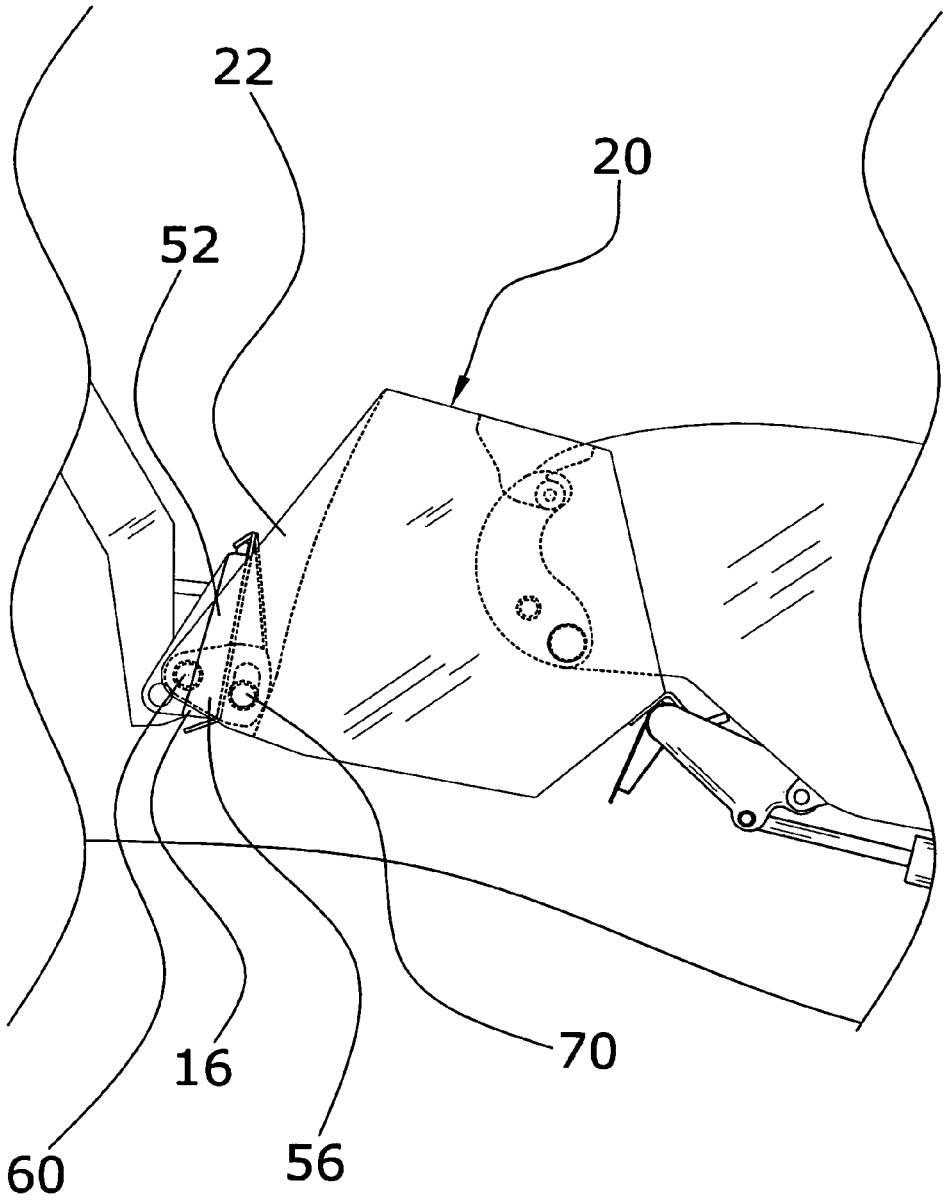
FIG. 7*c* is a magnified side view of the present invention from FIG. 6*c*.
Figure 8:
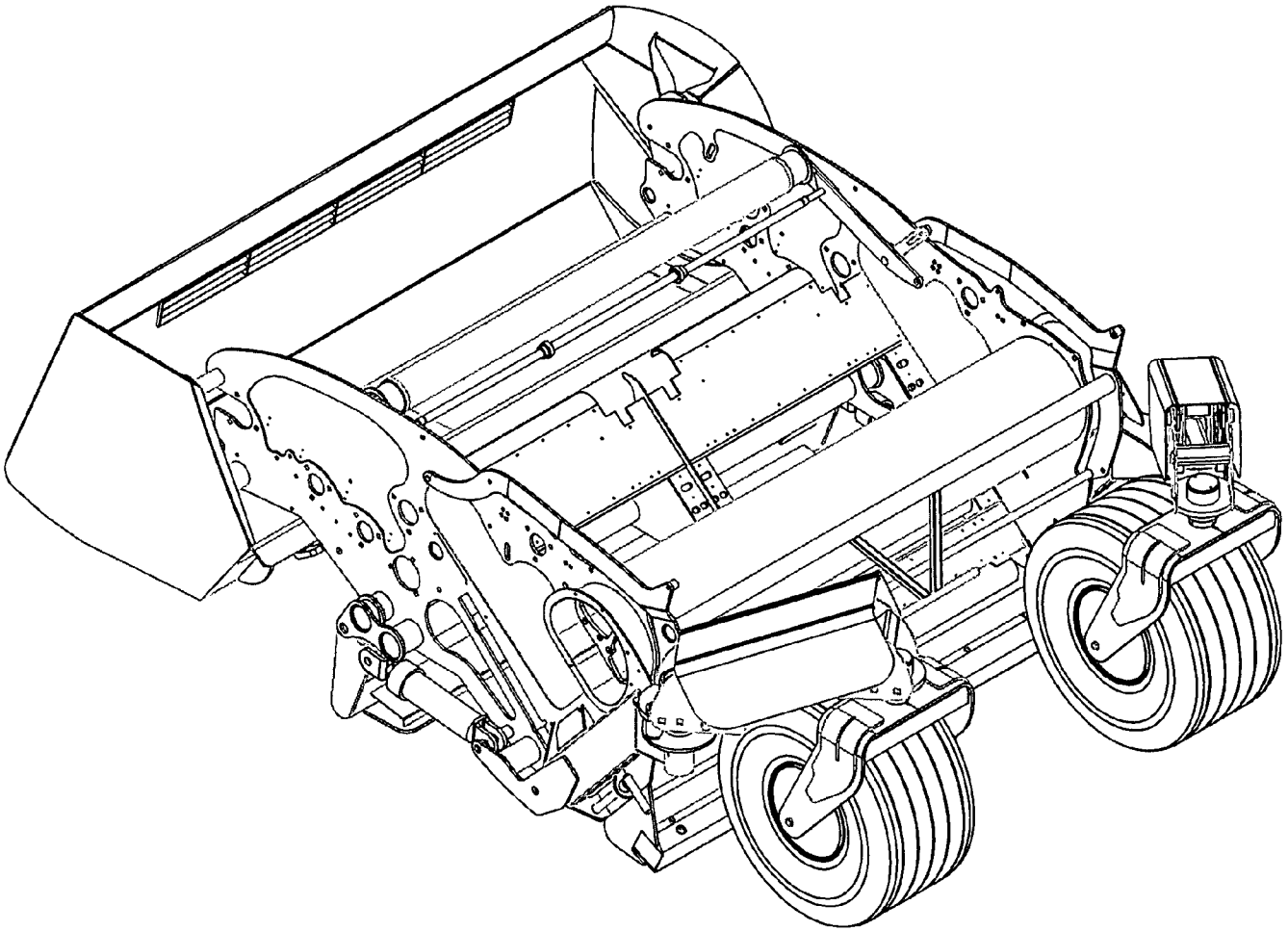
FIG. 8 is an upper perspective view of the present invention.
Figure 9:
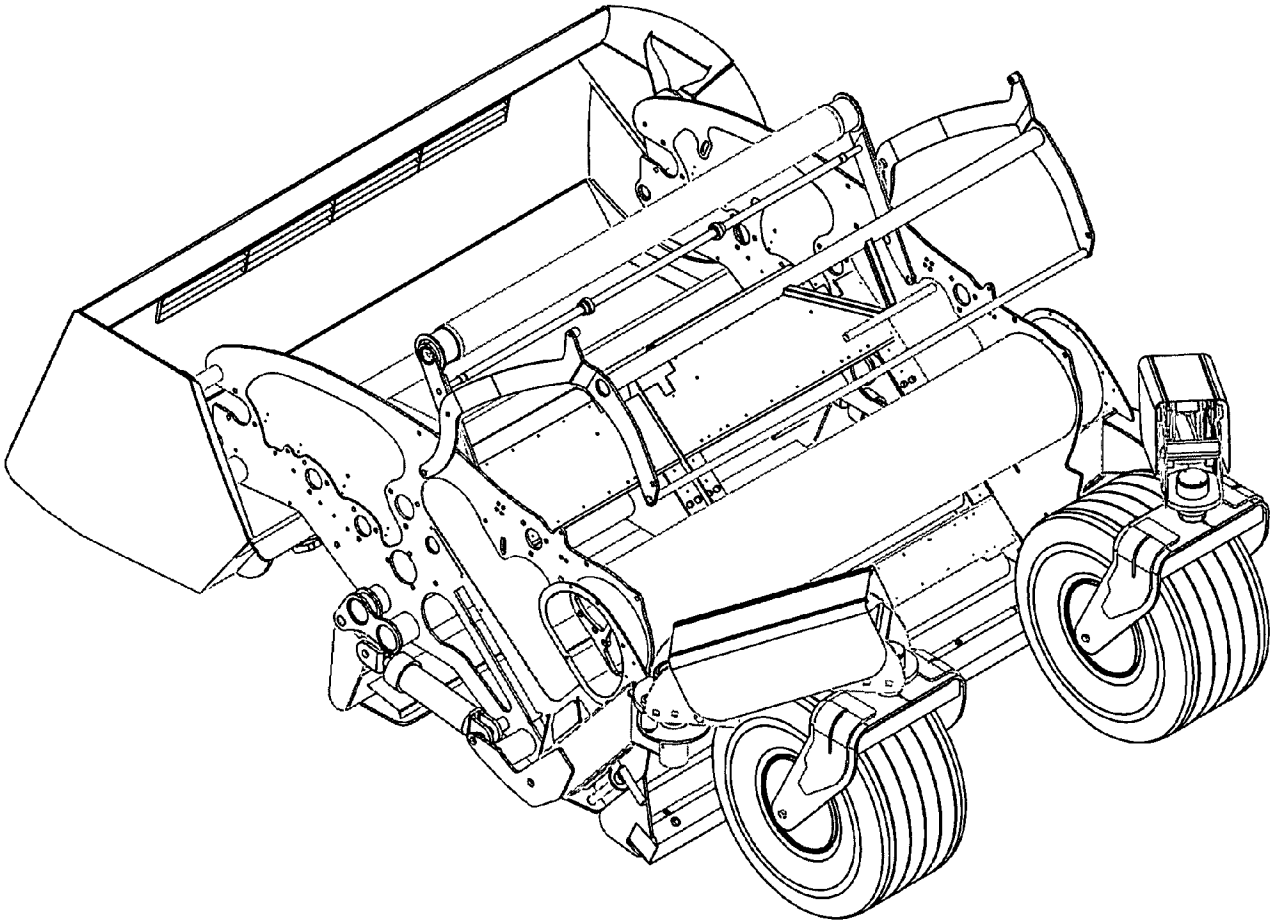
FIG. 9 is an upper perspective view of the present invention.

The attachment 20 may be comprised of various devices and machines that are supported by the front end loader 14 of a tractor 12 (e.g. skid steer tractor 12). The attachment 20 is preferably comprised of a ground surface cleaning machine similar to U.S. Pat. No. 6,094,847 which is hereby incorporated by reference into this application. The free pivoting movement between the pivoting connector 50 and the attachment 20 allows for greater operational efficiencies when utilized on uneven ground as best illustrated in FIGS. 6*b* and 6*c* of the drawings.

The attachment 20 preferably includes a pair of brackets 22 wherein the pivoting connector 50 is pivotally attached between the brackets 22 as best illustrated in FIGS. 1 through 4 of the drawings. The attachment 20 may be comprised of a bucket, wherein the bucket is removably attachable to a machine such as a ground surface cleaning machine. The attachment 20 may be comprised of various other machines and apparatus that require free pivoting between the front end loader 14 and the attachment 20.

C. Pivoting Connector

Figure 2:
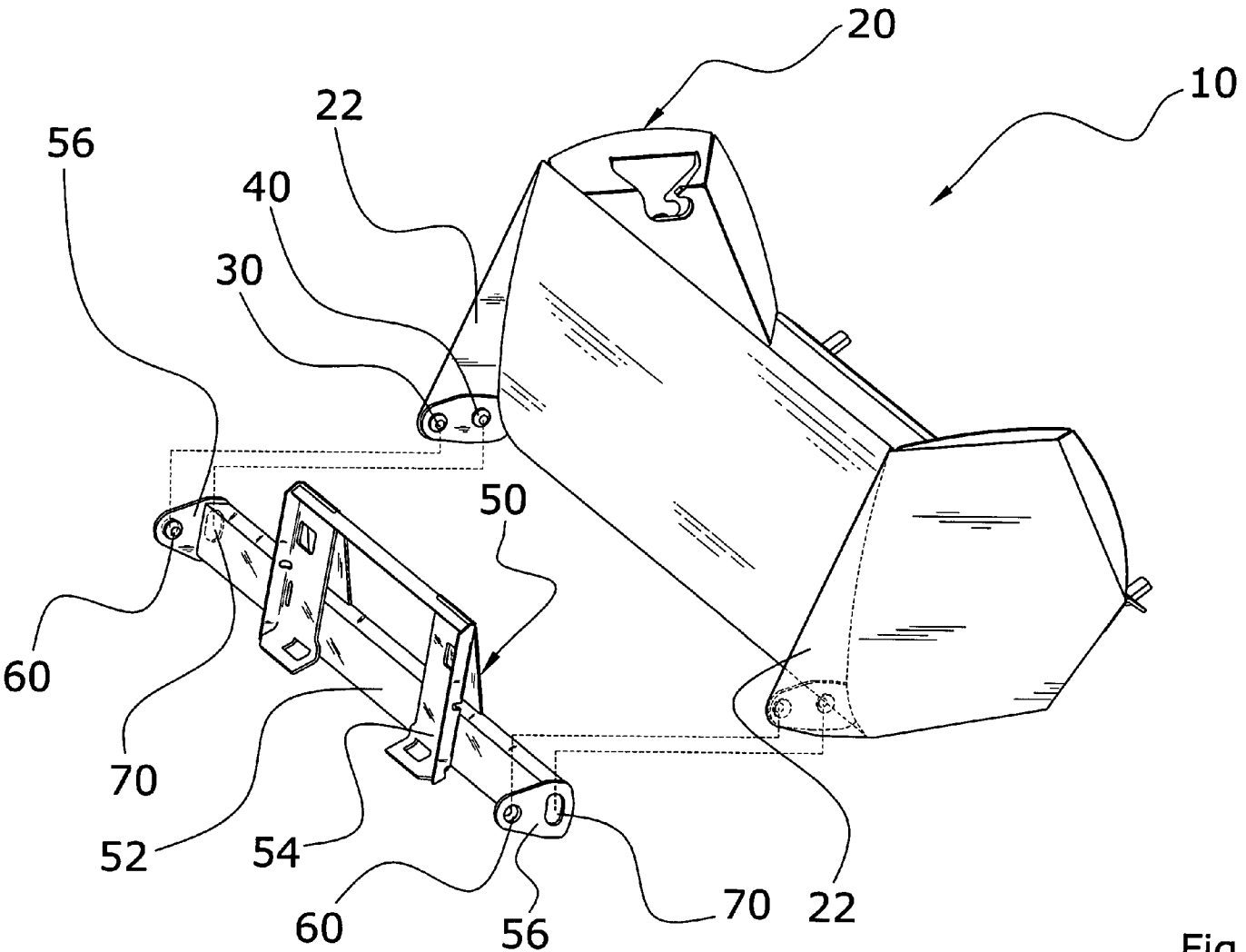
FIG. 2 is an exploded rear upper perspective view of the present invention.
Figure 3:
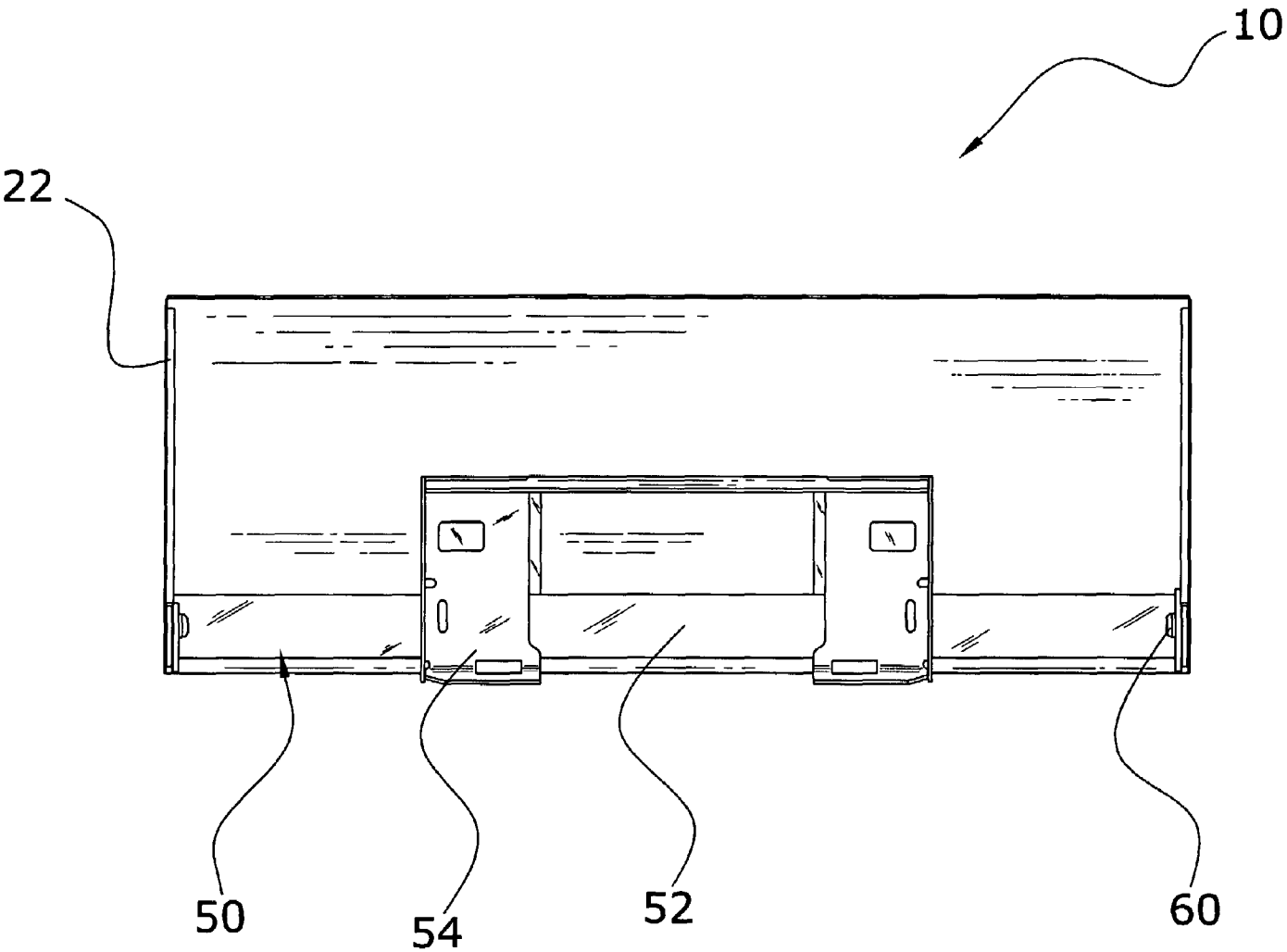
FIG. 3 is a rear view of the present invention.
Figure 4:
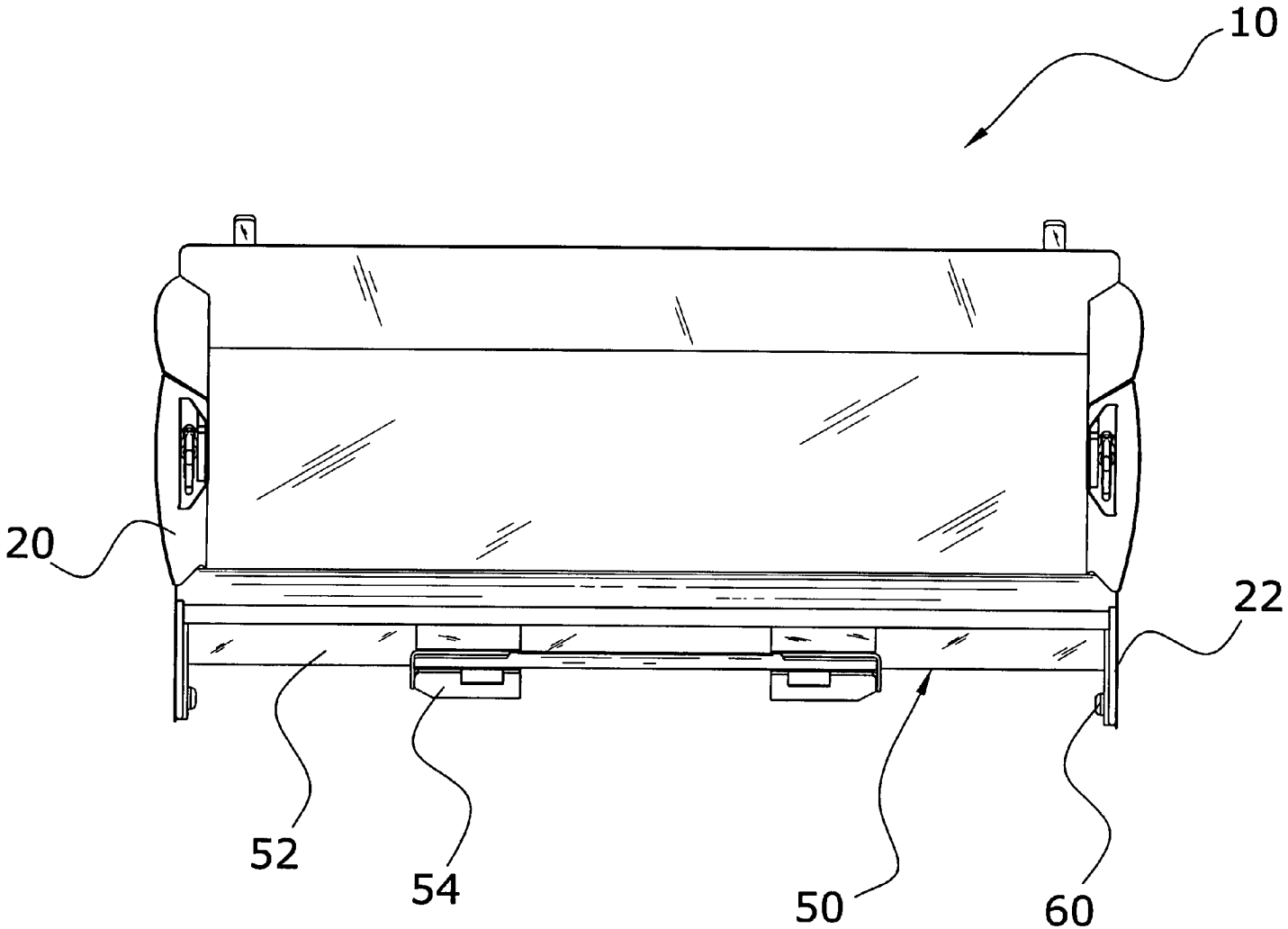
FIG. 4 is a top view of the present invention.
Figure 5A:
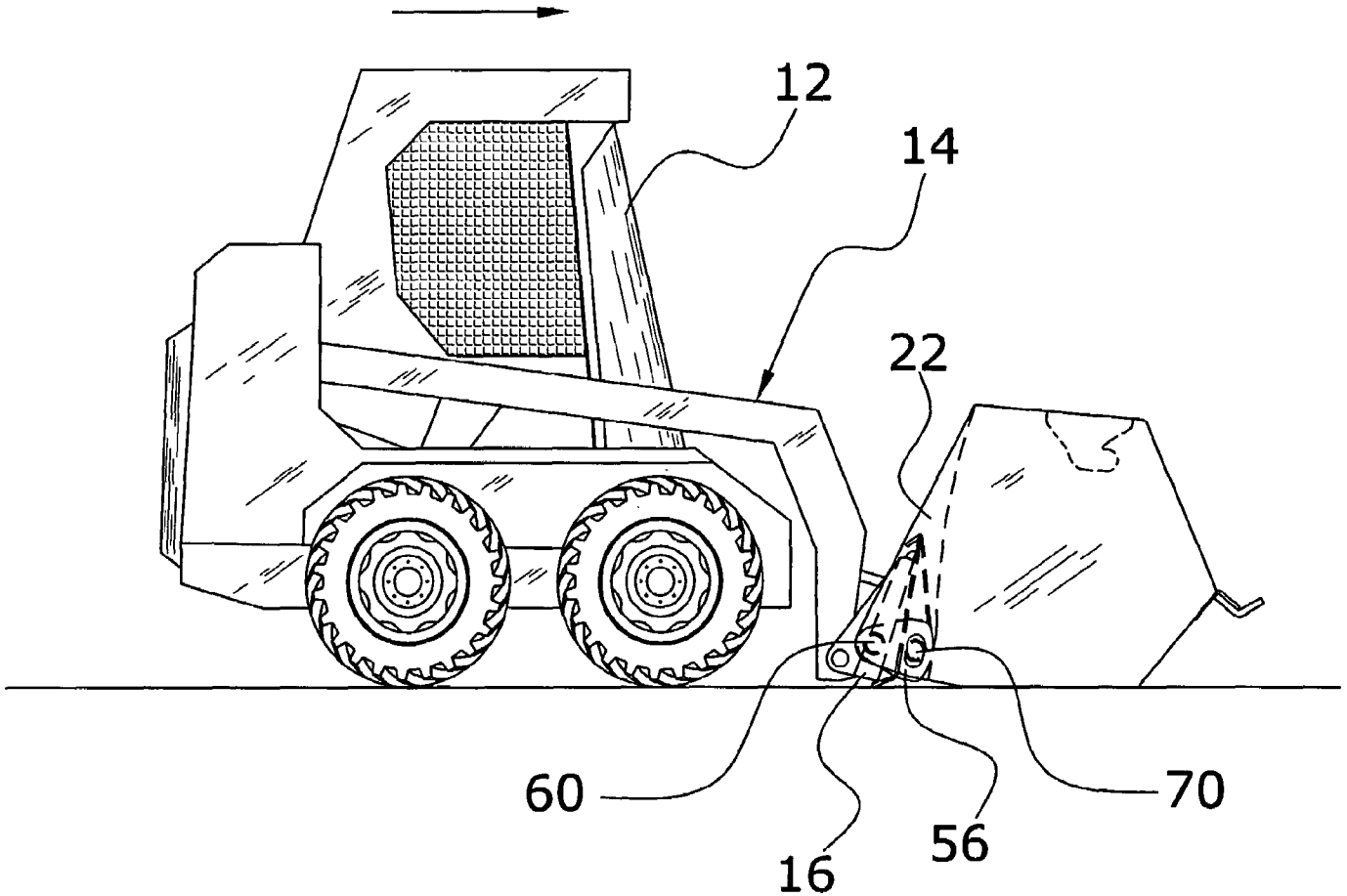
FIG. 5*a* is a side view of a tractor with the front end connector of the front end loader connecting with the quick attach of the present invention.
Figure 5B:
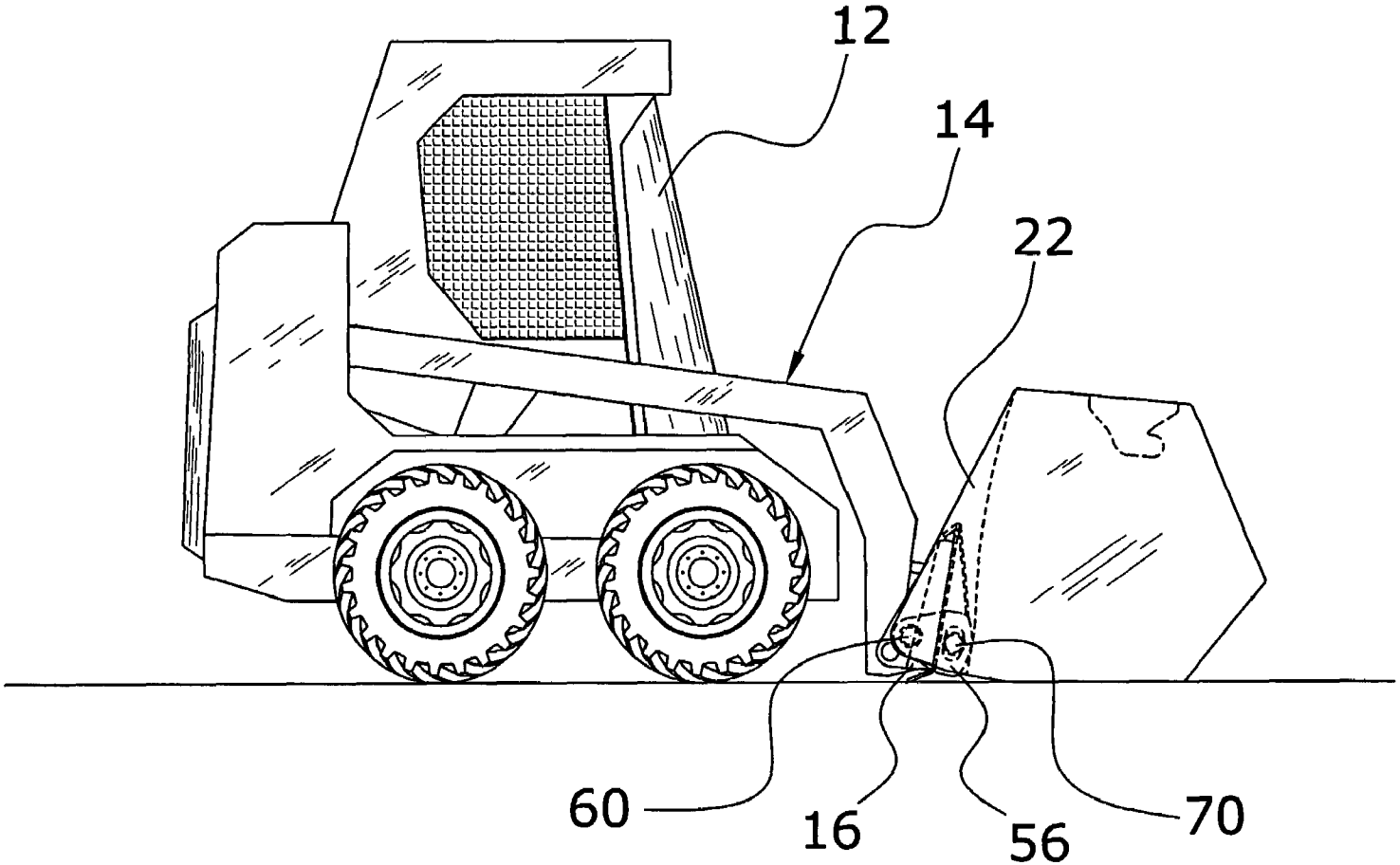
FIG. 5*b* is a side view of a tractor with the front end connector of the front end loader connected with the quick attach of the present invention.

The pivoting connector 50 is pivotally attached to the attachment 20 as best illustrated in FIG. 1 of the drawings. The pivoting connector 50 is preferably comprised of a support member 52 and a pair of side members 56 attached to opposing ends of the support member 52 as best illustrated in FIG. 2 of the drawings. The side members 56 are pivotally attached to the attachment 20 via various pivotal attaching devices.

A guide slot 70 extends within each of the side members 56 as further shown in FIG. 2 of the drawings. A pair of guide members 40 extend inwardly from the attachment 20 and movably extend within the guide slot 70 of each of the side members 56. The guide slot 70 limits the pivoting of the attachment 20 with respect to the pivoting connector 50 by the guide member 40 engaging the inner ends of the guide slot 70. The length of the guide slot 70 determines the amount of pivoting allowed for the attachment 20. The guide slot 70 preferably limits the pivoting of the attachment 20 with respect to the pivoting connector 50 to less than twenty-degrees.

A pair of pivot members 30 extend from the attachment 20 and a pivot receiver 60 extends within each of the side members 56 for pivotally receiving the pivot members 30 as best illustrated in FIG. 2 of the drawings. The pivot receiver 60 is preferably positioned rearwardly from the guide slots 70 as further shown in FIG. 2 of the drawings. The pivot members 30 and the pivot receiver 60 are preferably substantially concentric with a pivot point on the front end loader 14 and the front end connector 16 to reduce the lowering and raising of the attachment 20 when the front end connector 16 is tilted forwardly/rearwardly. The guide slots 70 are preferably curved along a radius having the pivot receiver 60 as a center point as further shown in FIG. 2 of the drawings.

D. First Connector

A first connector is attached to the pivoting connector 50 as illustrated in FIGS. 1 through 4 of the drawings. The first connector is removably attachable to a front end connector 16 of a front end loader 14 as illustrated in FIGS. 5*a* through 6*c* of the drawings. The first connector is preferably comprised a quick attach 54 commonly utilized upon skid steer tractors 12 and the like.

E. Operation of Invention

In use, the front end connector 16 of the front end loader 14 is attached to the pivoting connector 50. The pivoting connector 50 is attached to the attachment 20 (e.g. bucket attachable to a ground surface cleaning machine, a ground surface cleaning machine) and thereby allows for vertical support of the attachment 20 as illustrated in FIGS. 6*a* through 6*c* of the drawings. The attachment 20 may then be attached non-movably to a machine wherein a front portion of the machine is self-supported such as illustrated in FIGS. 6*a* through 6*c* of the drawings. The user then operates the tractor 12 thereby manipulating the machine in a desired manner over various types of terrain. In uneven terrain, as shown in FIGS. 6*b* and 6*c* of the drawings, the pivoting connector 50 pivots with respect to the attachment 20 in a free manner to prevent binding and excessive forces being applied to the front end loader 14 (or the attachment 20 and machine).

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A pivoting loader attachment system, comprising:

a pivoting connector pivotally attached to an attachment, wherein said attachment is comprised of a bucket; and a first connector attached to said pivoting connector, wherein said first connector is removably attachable to a front end connector of a front end loader;

wherein said pivoting connector is comprised of a support member, a pair of side members attached to opposing ends of said support member, wherein said side members are pivotally attached to said attachment, a guide slot extending within each of said side members, and a pair of guide members extending from said attachment and movably extending within said guide slot of each of said side members.

2. The pivoting loader attachment system of claim 1, wherein said first connector is comprised of a quick attachment.

3. The pivoting loader attachment system of claim 1, wherein said guide slot limits the pivoting of said attachment with respect to said pivoting connector.

4. The pivoting loader attachment system of claim 1, wherein said guide slot limits the pivoting of said attachment with respect to said pivoting connector to less than twenty-degrees.

5. The pivoting loader attachment system of claim 1, including a pair of pivot members extending from said attachment and a pivot receiver extending within each of said side members for pivotally receiving said pivot members.

6. The pivoting loader attachment system of claim 5, wherein said pivot receiver is positioned rearwardly from said guide slots.

7. The pivoting loader attachment system of claim 5, wherein said guide slots are curved along a radius having said pivot receiver as a center point.

8. The pivoting loader attachment system of claim 1, wherein said attachment includes a pair of brackets and wherein said pivoting connector is pivotally attached between said brackets.

9. The pivoting loader attachment system of claim 1, wherein said attachment is comprised of a ground surface cleaning machine.

10. The pivoting loader attachment system of claim 1, wherein said bucket is removably attached to a machine.

11. A pivoting loader attachment system, comprising:

a pivoting connector pivotally attached to an attachment;

a first connector attached to said pivoting connector, wherein said first connector is removably attachable to a front end connector of a front end loader;

wherein said pivoting connector is comprised of a support member, a pair of side members attached to opposing ends of said support member, wherein said side members are pivotally attached to said attachment, a guide slot extending within each of said side members, and a pair of guide members extending from said attachment and movably extending within said guide slot of each of said side members;

wherein said guide slot limits the pivoting of said attachment with respect to said pivoting connector;

wherein said first connector is comprised of a quick attachment; and a pair of pivot members extending from said attachment and a pivot receiver extending within each of said side members for pivotally receiving said pivot members;

wherein said pivot receiver is positioned rearwardly from said guide slots;

wherein said guide slots are curved along a radius having said pivot receiver as a center point;

wherein said attachment includes a pair of brackets and wherein said pivoting connector is pivotally attached between said brackets;

wherein said attachment is comprised of a ground surface cleaning machine or a bucket.

12. The pivoting loader attachment system of claim 11, wherein said guide slot limits the pivoting of said attachment with respect to said pivoting connector to less than twenty-degrees.

* * * * *